US005249643A

United States Patent [19]

Backer et al.

[11] Patent Number: 5,249,643

[45] Date of Patent: Oct. 5, 1993

[54] VEHICULAR SELF-PROPELLED AERIAL WORK PLATFORM AND TELESCOPING PARALLELOGRAM BOOM THEREFOR

[75] Inventors: Robert D. Backer, Rouzerville; Donald C. Hade, Jr., Waynesboro, both of Pa.

[73] Assignee: Kidde Industries, Inc., Iselin, N.J.

[21] Appl. No.: 863,035

[22] Filed: Apr. 3, 1992

[51] Int. Cl.[5] ..... B66F 11/04

[52] U.S. Cl. ..... 182/2; 212/188; 52/118

[58] Field of Search ..... 182/2, 63, 68; 52/118; 212/187, 188, 184

[56] References Cited

U.S. PATENT DOCUMENTS

| | | | |
|---|---|---|---|
| 3,584,703 | 6/1971 | Lane | 182/52 |
| 3,891,056 | 6/1975 | Ashworth | 182/2 X |
| 4,179,010 | 12/1979 | Ashworth | 182/2 |
| 4,222,457 | 9/1980 | Ashworth | 182/2 |
| 4,518,059 | 5/1985 | Frey-Wigger | 182/2 |
| 4,754,840 | 7/1988 | MacDonald et al. | 182/2 |
| 4,757,875 | 7/1988 | Hade, Jr. et al. | 182/2 |
| 4,775,029 | 10/1919 | MacDonald et al. | 182/2 |
| 4,964,778 | 10/1990 | Muto et al. | 414/700 |
| 4,979,588 | 12/1990 | Pike et al. | 182/2 X |

*Primary Examiner*—Alvin C. Chin-Shue
*Attorney, Agent, or Firm*—Brady, O'Boyle & Gates

[57] ABSTRACT

A vehicular self-propelled aerial work platform wherein a lower telescopic boom assembly is connected to a riser frame assembly having an upper telescopic boom assembly also connected thereto. A work platform is connected to the outer end of the upper telescopic boom assembly. Both the lower telescopic boom assembly and the upper telescopic boom assembly can be elevated and extended to increase the reach of the aerial work platform. The lower telescopic boom assembly comprises tubular telescoping boom sections connected at opposite ends between a support on a turntable and the riser frame assembly, with a telescopic cylinder extending interior of the boom sections and connected at opposite ends between the same members providing a telescoping parallelogram boom mechanism, with hydraulic controls with interlocks for operating the boom in a predetermined sequence.

30 Claims, 6 Drawing Sheets

VEHICULAR SELF-PROPELLED AERIAL WORK PLATFORM AND TELESCOPING PARALLELOGRAM BOOM THEREFOR

BACKGROUND OF THE INVENTION

A vehicular propelled aerial work platform is disclosed in U.S. Pat. No. 4,757,875, dated Jul. 19, 1988, and owned by the assignee of the present invention, wherein a parallelogram linkage is provided between a superstructure support frame carried by the vehicle turntable, and a riser frame assembly to which one end of a telescopic boom assembly is pivotally connected and having an aerial work platform mounted on the outermost end of the telescopic boom assembly. By this construction and arrangement, the reach of the aerial platform has been extended to a greater distance than heretofore. While the vehicular propelled aerial work platform disclosed in the aforementioned patent has been satisfactory for its intended purpose, the vehicular propelled aerial work platform of the present invention is an improvement thereon.

SUMMARY OF THE INVENTION

To further increase the reach of the aerial work platform of the type disclosed in the aforementioned patent, the vehicular propelled aerial work platform of the present invention comprises, essentially, a telescoping parallelogram linkage between the superstructure support frame and the riser frame assembly, wherein the parallelogram linkage includes a lower telescopic boom assembly including a lower boom section pivotally connected at one end to the superstructure support frame, a fly section slidably mounted in the lower boom section and having its outer end pivotally connected to the riser frame assembly, and a lower telescopic cylinder assembly having its cylinder end pivotally connected to the superstructure support frame and its rod end pivotally connected to the riser frame assembly, whereby a telescopic parallelogram assembly is provided to elevate the riser frame assembly, and which can be extended in a vertical plane to form a rigid column, which, together with the aerial platform carrying telescopic boom assembly pivotally connected to the riser frame assembly further increases the reach of the aerial platform with a very stable mechanism.

DESCRIPTION OF THE PREFERRED EMBODIMENT

Figure 1:
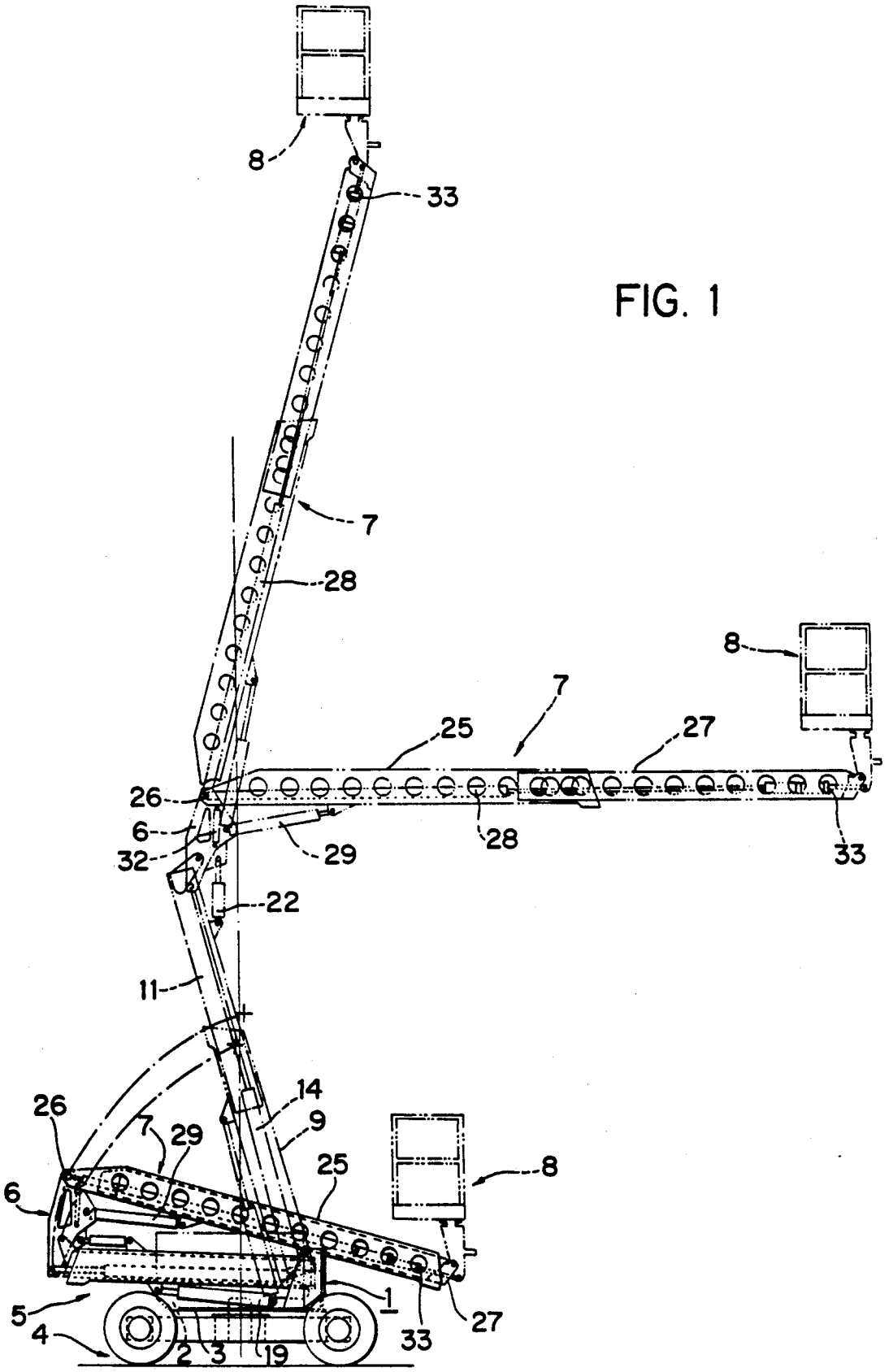
FIG. 1 is an elevational view of the vehicular propelled aerial work platform of the present invention showing the work platform in various working positions.
Figure 2:
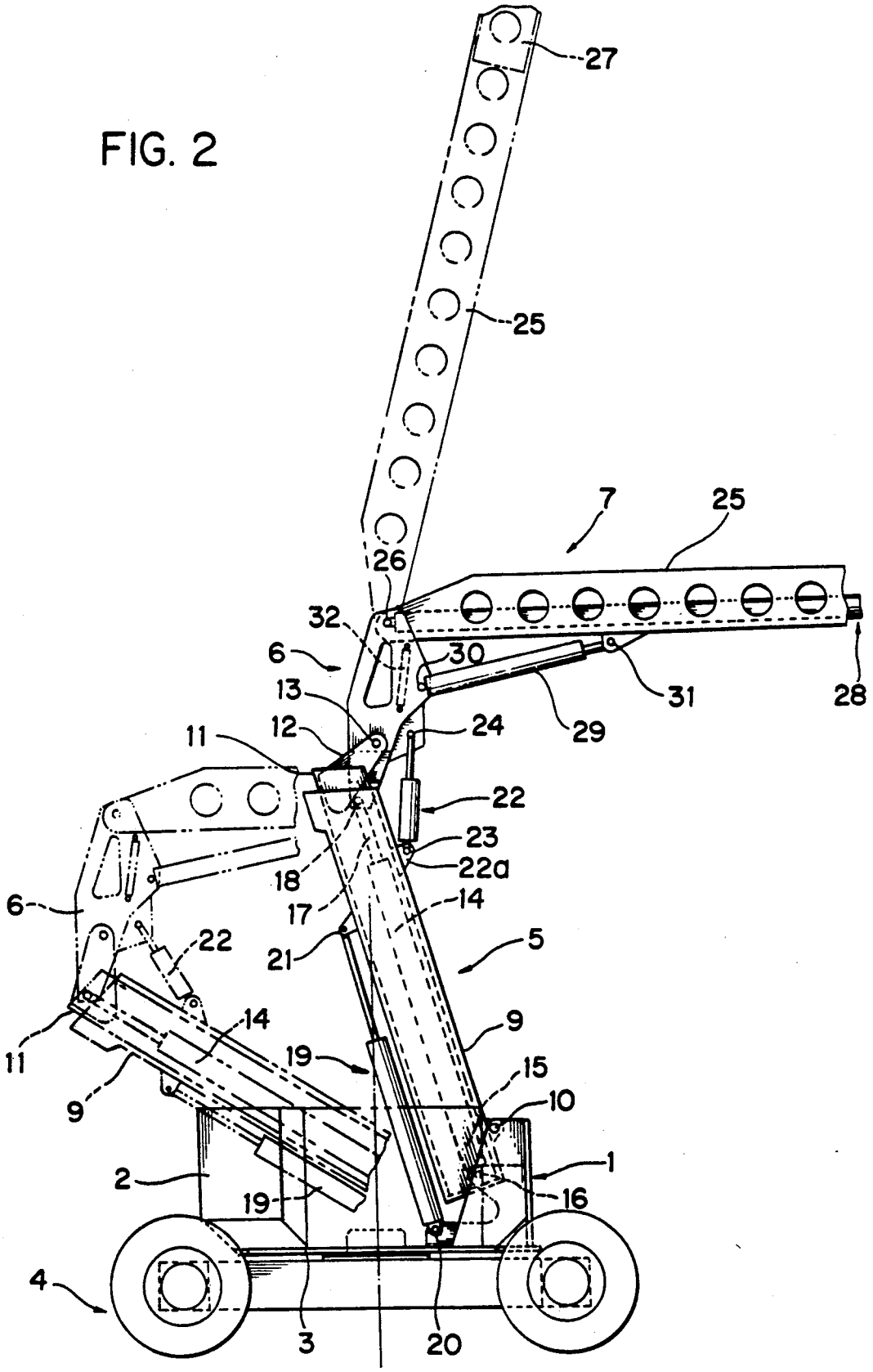
FIG. 2 is a fragmentary side elevational view, with parts broken away for clarity, showing the parallelogram linkage for raising the riser frame assembly from a stored position to an elevated position.

Referring to the drawings, and more particularly to FIGS. 1 and 2 in greater detail, the vehicular propelled aerial work platform of the present invention comprises a turntable 3 mounted for rotation about a vertical axis on and carried by a vehicle chassis 4. A superstructure support frame 1 is mounted on one end of the turntable 3 and a counterweight 2 is mounted on the other end and on the opposite side of the rotation axis. A lower telescopic boom assembly 5 forming a parallelogram linkage is mounted between the superstructure support frame 1 and a riser frame assembly 6 to which one end of an upper telescopic boom assembly 7 is connected having a work platform 8 mounted on the opposite end thereof.

Figure 3:
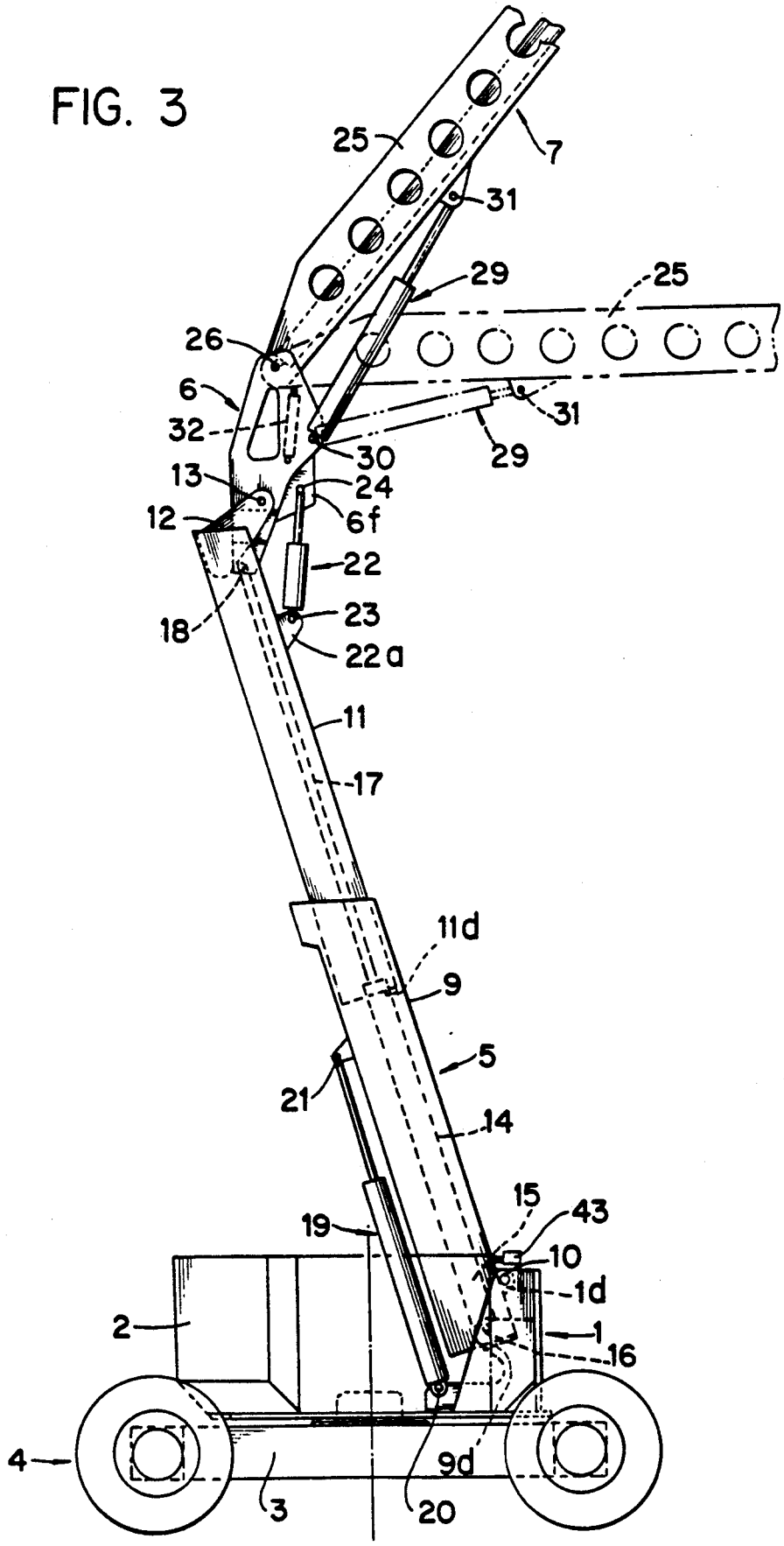
FIG. 3 is a fragmentary side elevational view showing the riser frame assembly and the telescopic parallelogram assembly in the extended position.
Figure 4:
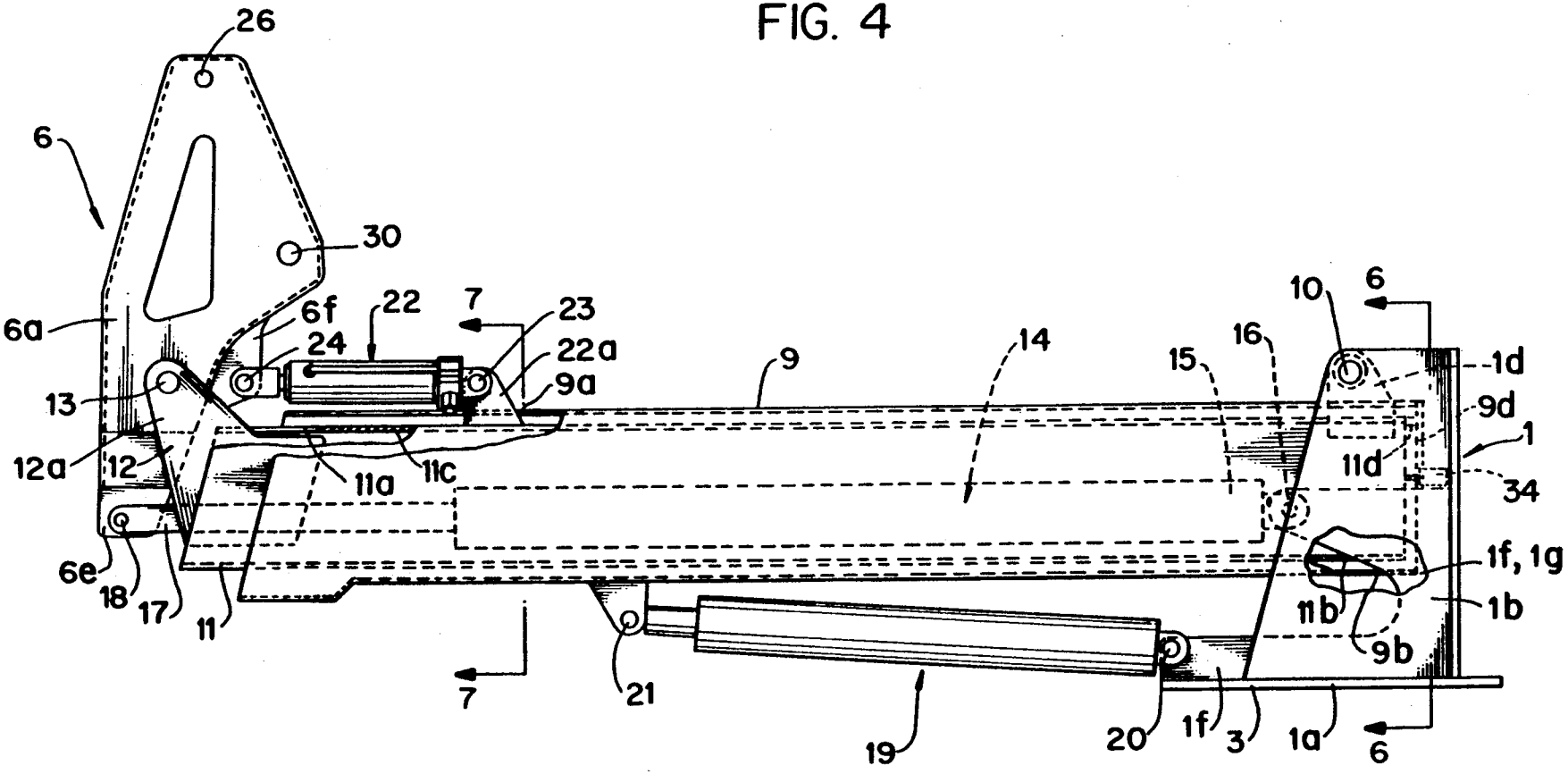
FIG. 4 is a side elevational view, partly in section, showing the details of the telescopic parallelogram linkage assembly in the retracted position connected to the riser assembly.
Figure 5:
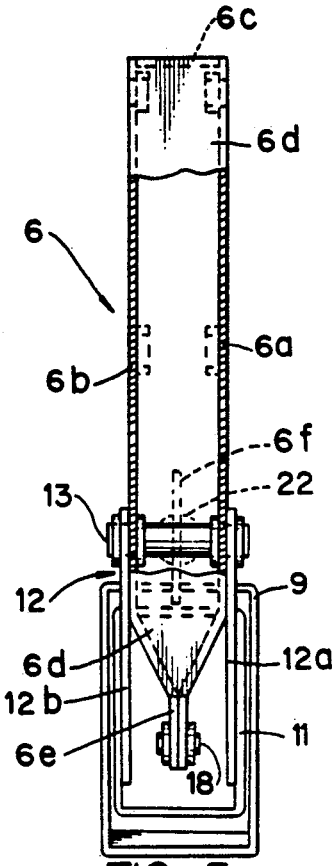
FIG. 5 is an end elevational view partly in broken-away section as viewed from the left in FIG. 4.

As will be seen in FIGS. 2 and 3, the lower telescopic boom assembly 5 for raising and lowering the riser frame assembly 6, comprises, a tubular base boom section 9 pivotally connected at one end to the superstructure support frame 1 as at 10, a tubular fly section 11 telescopically slidably mounted in the base section 9 and having its outer end portion 12 pivotally connected to the riser frame assembly 6 as at 13, and a lower telescopic cylinder 14, for extending the fly section from the base section, extending interior of the boom sections 9 and 11 and having its cylinder end 15 pivotally connected to the support frame 1 as at 16 and its rod end 17 pivotally connected to the riser frame 6 as at 18. The boom sections are preferably polygonal in cross-section, such as rectangular, square, trapezoid, or the like, but can also have other cross-sectional shapes.

In order to elevate the lower telescopic boom assembly 5 and associated riser frame assembly 6 from the lowered or stored position, as shown in solid lines in FIG. 1, to the elevated position, as shown in solid lines in FIG. 2, a lower lift cylinder 19 is provided having its cylinder end pivotally connected to the superstructure frame assembly 1 as at 20 and its rod end pivotally connected to the base section 9 as at 21.

Figure 8:
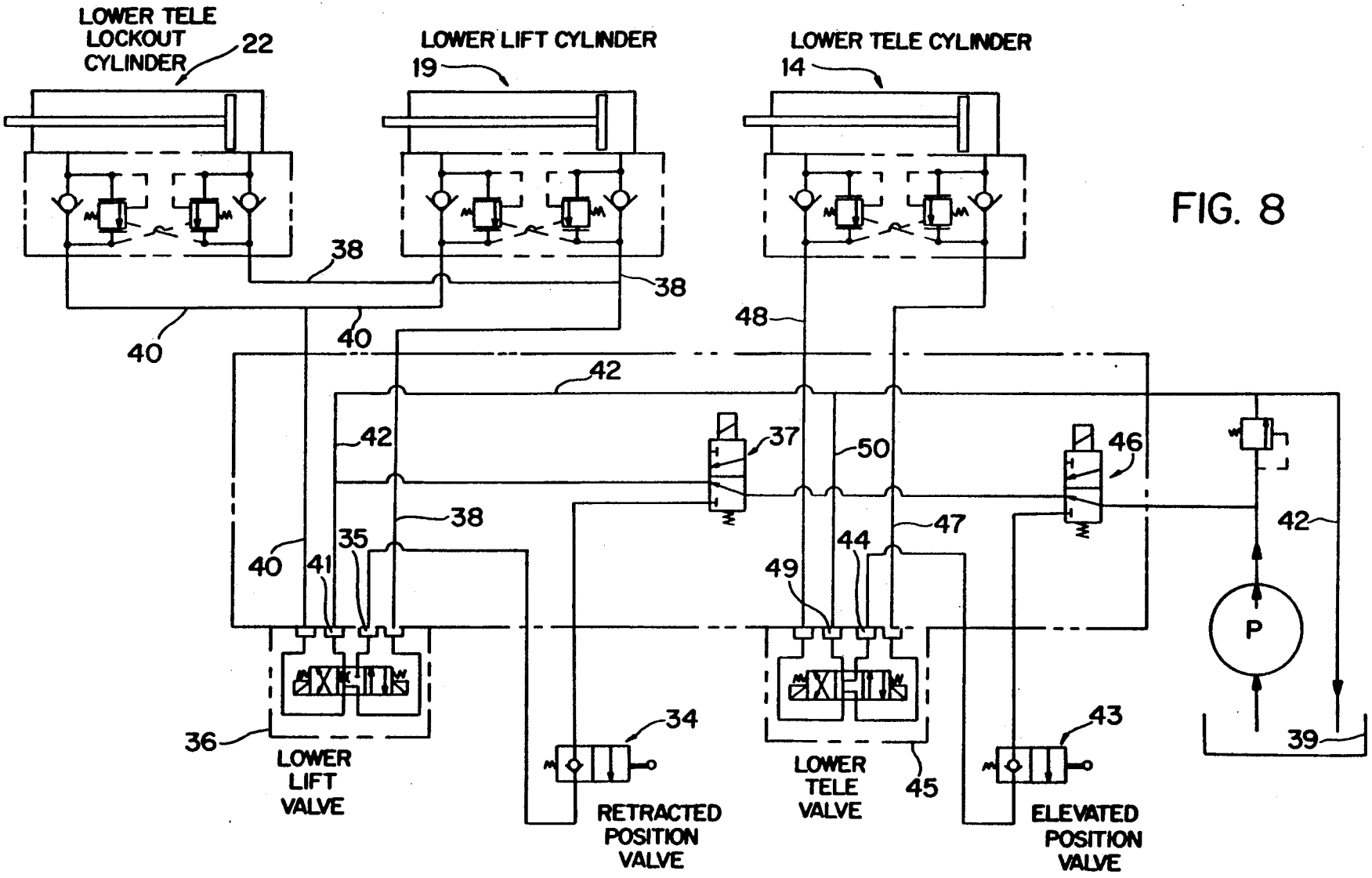
FIG. 8 is a schematic diagram of the hydraulic circuit for controlling the lower telescopic lockout cylinder, lower lift cylinder and lower telescopic cylinder assemblies.

A lower telescopic lockout cylinder 22 is provided having its cylinder end pivotally connected to the fly section as at 23 and its rod end pivotally connected to the riser frame assembly 6 as at 24, whereby a rigid link is provided between the fly section 11 and riser frame assembly 6 when the lower telescopic boom assembly 5 is moved to the elevated position, as shown in FIG. 2, so that the fly section 11 can then be moved to the extended position, as shown in FIG. 3, to be described more fully hereinafter in connection with the hydraulic circuit shown in FIG. 8.

Referring to FIGS. 1 and 2, the upper telescopic boom assembly 7 has a base section 25 pivotally connected to the riser frame 6 as at 26 and a fly section 27 slidably mounted in the base section 25. A telescopic fluid motor 28 is connected between the base section 25 and fly section 27 to effect the telescopic movement of the fly section 27 relative to the base section 25. A lift cylinder 29 is pivotally connected to the riser frame 6 as at 30 and to the base section 25 as at 31, whereby the upper telescopic boom assembly 7 can be elevated to various positions as shown in phantom. The work platform 8 is pivotally connected to the distal end of the fly section 27, and is maintained in a horizontal plane during the raising and lowering of the upper boom assembly 7 by a conventional hydraulic levelling control circuit including a control cylinder 32 mounted between the riser frame assembly 6 and the base section 25, and a slave cylinder 33 positioned at the end of the fly section 27 and pivotally connected to the work platform 8.

The details of the construction of the lower telescopic boom assembly 5 and associated riser frame assembly 6 are illustrated in FIGS. 4 to 7, wherein the riser frame assembly 6 comprises a housing having side walls 6*a* and 6*b*, a top wall 6*c* and end wall 6*d*. The lower portion of the side walls 6*a* and 6*b* taper inwardly to an abutting position at 6*e* to accommodate the pivot connection 18 for the rod end 17 of the lower telescopic cylinder 14. The outer end portion 12 of the fly section 11 comprises a pair of spaced plates 12*a* and 12*b* welded to the inner side walls of the fly section and extending upwardly therefrom through a notch 11*a* in the outer end of the top wall of fly section 11, to straddle the riser frame side walls 6*a* and 6*b* through which the pivot connection 13 is made. The notch 11*a* is of sufficient length to provide clearance for the lower portion 6*a* of riser frame assembly 6 as it pivots about pivot connection 13, as shown in FIGS. 1, 2 and 3, as the lower telescopic boom assembly 5 is raised to its uppermost position, as shown.

The superstructure support frame 1 comprises a base plate 1*a*, which can be the same as turntable 3, supporting a pair of spaced parallel plates 1*b* and 1*c* which straddle a pair of brackets 1*d* and 1*e* which are welded to the side walls of the base section 9, through which the pivot connection 10 is made. Another pair of plates 1*f* and 1*g* are mounted on the base plate 1*a* in abutting face-to-face relationship, and positioned between plates 1*b* and 1*c*, and accommodate the pivot connection 20 for the lift cylinder 19 and the pivot connection 16 for the cylinder end 15 of the lower telescopic cylinder 14, the bottom walls of the base and fly sections 9 and 11 having slots 9*b* and 11*b* to accommodate the plates 1*f* and 1*g*, when lower telescopic boom assembly 5 is moved to its lowered position.

The pivotal connection 23 for the lower tele lockout cylinder 22 is connected to a bracket 22*a* fixed to the upper wall 11*c* of the fly section 11 and extending upwardly therefrom through a slot 9*a* provided in the top wall of and extending inwardly from the outer end of the base section 9. The rod end of the lower tele lockout cylinder 22 is connected at 24 to a plate 6*f* welded to the end wall 6*d* of the riser frame assembly and extending outwardly therefrom. Slot 9*a* enables fly section 11 with the tele lockout cylinder connecting bracket 22*a* thereon, to be fully retracted into base section 9.

In the fully retracted position of fly section 11 in base section 9, a stop member 11*d*, such as a bar or plate, connected across the inner end of fly section 11, abuts against a cooperating stop plate 9*d* connected on the inner end of base section 9.

Figure 6:
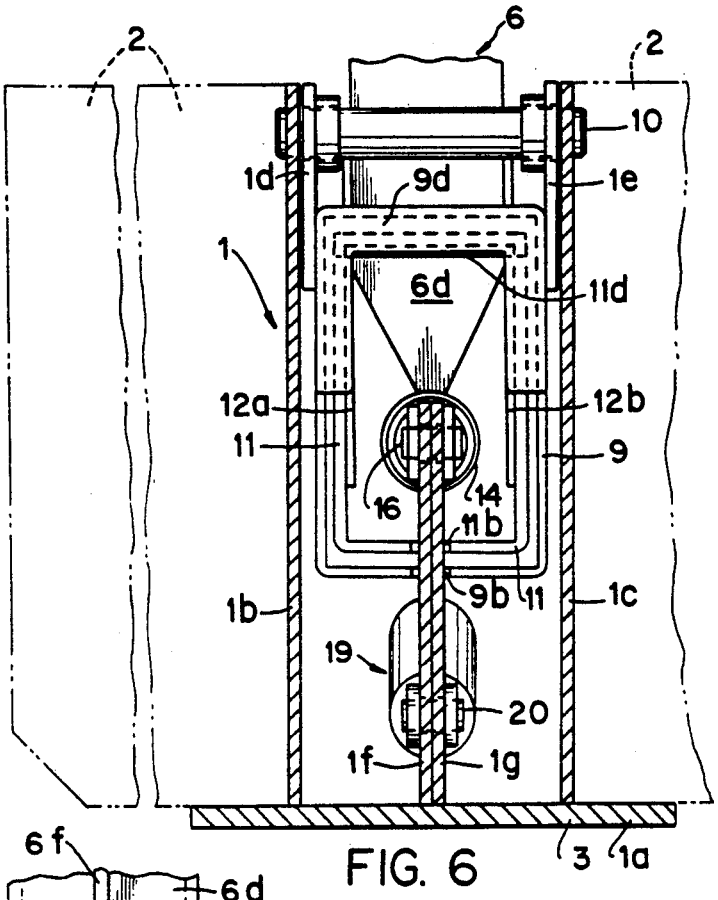
FIG. 6 is a vertical section view taken substantially along line 6—6 of FIG. 4, and shown in fore-shortened phantom lines.
Figure 7:
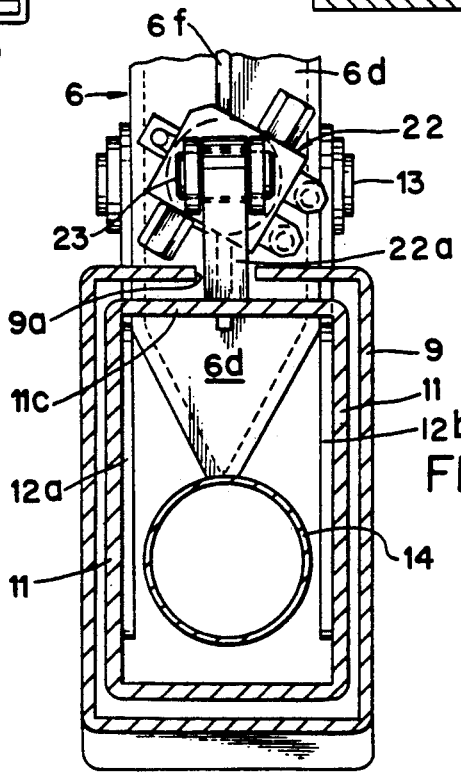
FIG. 7 is a view taken substantially along line 7—7 of FIG. 4.

As shown in FIGS. 6 and 2, all of the components of the vehicular propelled aerial work platform are symmetrically connected along the center line of the vehicle chassis as in U.S. Pat. No. 4,757,875. A trough is provided through the counterweight 2 in alignment with the support frame 1 along the horizontal centerline or center axis of the turntable. All of the components thus lie in a vertical plane that includes that horizontal center axis, namely lower lift cylinder 19, lower boom assembly 7, upper lift cylinder 29, and work platform 8, thus providing a very symmetrically balanced and stable mechanism, to enable the much higher reach to be achieved by the work platform 8.

Referring mainly to the schematic hydraulic diagram of FIG. 8 and FIGS. 1, 2 and 3, the platform is operated in the following manner to manipulate it from its lowered stowed position, shown in full lines in FIG. 1, to its maximum raised position, shown in phantom lines at the top portion of FIG. 1. In FIG. 8, all valves are shown in the neutral positions.

The lower tele cylinder 14 and lower telescopic boom assembly 5 are initially fully retracted, whereby fly section 11 is fully retracted into base section 9, with cooperating stop members 11*d* and 9*d* in abutment, which actuates a retracted position valve 34 to the left, from the neutral position shown, that permits hydraulic fluid to reach the pressure port 35 of the lower lift valve 36. Lower lift valve 36 is then operated to the left, as shown in FIG. 8, after actuating valve 37 to the position opposite to the position shown, to allow the lower lift cylinder 19 to extend by supplying pressurized fluid thereto from the pump P via hydraulic line 38, thereby raising the lower boom assembly 5, as shown in FIGS. 1, 2 and 3 from the substantially horizontal stowed position to the fully raised position, of for example, approximately 75° from the horizontal.

The extension of the lower lift cylinder 19, and thus the raising of the lower boom assembly 5, can be stopped at any position between its minimum and maximum stroke, such as at the position shown in phantom line in FIG. 2. The lower tele cylinder 14 will not function to extend fly section 11 from base section 9 until the lower lift cylinder 19 reaches its maximum stroke; but at any intermediate position, the upper lift cylinder 29 and upper tele cylinder 28, not shown in the schematic hydraulic diagram of FIG. 8 since they are connected for operation in the conventional manner, can be operated to position the work platform 8 at a desired location. As the lower lift cylinder 19 extends to move the lower boom assembly 5 upwards, as shown in FIGS. 1 and 2, the lower tele lockout cylinder 22 also extends as much as the geometry of the apparatus requires it to extend, since it is also simultaneously supplied pressurized fluid via hydraulic line 38. Because of the parallelogram pivot connections 13 and 18, raiser frame 6 always remains in the same vertically oriented position as lower boom assembly 5 is raised from the lowered to the raised position, since it pivots counter-clockwise about pivot connection 13, as shown in FIG. 2.

Lower tele lockout cylinder 22 is simultaneously supplied with hydraulic fluid flow to assure that it is full of hydraulic fluid when the lower lift cylinder 19 reaches its maximum stroke, so that the lower tele cylinder 14 can thereafter be extended, since at this time, the lower tele lockout cylinder 22 with its holding valves, becomes a rigid structural member.

Hydraulic fluid from the opposite side of the pistons in the lower lift cylinder 19 and lower tele lockout cylinder 22 is returned to the reservoir 39 via hydraulic line 40, return port 41 of lower lift valve 36, and return line 42.

When the lower lift cylinder 19 reaches its maximum stroke at which the lower boom assembly 5 is raised to an elevation of, for example, approximately 75°, as shown in phantom lines in FIG. 1, and in full lines in FIG. 2, an elevated position valve 43 is automatically actuated, moved to the left in FIG. 8, which permits hydraulic fluid flow to reach the pressure port 44 of the lower tele cylinder valve 45. At this time, lower lift valve 36 is returned to its neutral position, as shown, and the holding valves shown on the cylinders lock the hydraulic fluid in the cylinders, and lock both lower lift cylinder 19 and lower tele lockout cylinder 22 in their extended positions. In this locked extended position, lower tele lockout cylinder 22 becomes a rigid structural member effectively rigidly connecting together the end of fly section 11 and the end of lower tele cylinder 14 through riser frame 6 in its vertically oriented position. Valve 37 then returns to its original position, as shown in FIG. 8, directing hydraulic fluid flow back to the reservoir 39 via return line 42.

When lower boom assembly 5, in its fully retracted position, is being raised by lower lift cylinder 19, hydraulic fluid is locked within lower tele cylinder 14 by its holding valves so it is a rigid member. The retracted boom sections 9, 11 with their stop members **9*d*, 11*d* in abutment, form a rigid member in compression. Thus, the rigid retracted boom sections 9, 11, and rigid retracted lower tele cylinder 14 extending parallel with and inside the boom sections, each connected at their opposite ends to the unmoving support frame 1 and the rotatable riser frame 6, function as a parallelogram linkage as the lower boom assembly 5 is raised, wherein one link is inside the other link. This structural arrangement of the lower boom assembly 5 provides a very stable structure laterally in all directions for the upper boom assembly 7 and work platform 8. During this raising and lowering operation, the lower tele cylinder 14 functions as a tension member and the boom sections 9, 11 function as a compression member. In the raised position of the lower boom assembly, due to the cantilevered load of the riser frame 6, upper boom assembly 7, and work platform 8, lower lift cylinder 19** is in tension.

Lower tele cylinder control valve 45 is then operated to the left as shown in FIG. 8, after actuating valve 46 to the position opposite to the position shown, to allow the lower tele cylinder 14 to extend, to extend fly section 11 from base section 9 of lower boom assembly 5, by supplying pressurized fluid thereto via hydraulic line 47. As lower tele cylinder 14 extends fly section 11 from base section 9, that is from the position shown in full lines in FIG. 2 to the position shown in FIG. 3, retracted position valve 34, as soon as there is slight extension of fly section 11, is automatically returned to the valve position as shown, and hydraulic fluid is trapped in lower lift cylinder 19 and in lower tele lockout cylinder 22, by the holding valves therein, to retain them in their fully extended states as rigid structural member. Lower tele cylinder 14 cannot be extended until lower tele lockout cylinder 22 has hydraulic fluid locked therein. Fluid from the opposite side of the piston in the lower tele cylinder 14 is returned to the reservoir 39 via hydraulic line 48, return port 49 of lower tele valve 45, and return lines 50 and 42.

When valve 46 is actuated, flow of pressurized hydraulic fluid is cut-off to valve 37 and is diverted to elevated position valve 43 so that lower tele cylinder 14 can be extended by lower tele valve 45.

When the lower boom assembly 5 is extended from the position shown in FIG. 2 to that shown in FIG. 3, it is no longer functioning as a parallelogram, but is rather functioning as a regular extendable boom or tower, but with greater stability. In the extended position of the lower boom assembly shown in FIG. 3, tele lockout cylinder 22 is in compression, and functions as a rigid structural member to transfer the compressive load of the upper boom assembly 7, and work platform 8 from riser frame 6 to the top portion of fly section 11. Lower tele cylinder 14 is in compression, and as previously stated, lower lift cylinder 19 is in tension, with the lower or bottom wall portion of boom sections 11 and 9 being in tension while their upper or top wall portions are in compression. Greater stability in all lateral directions and less flexing of the lower boom assembly is provided by this extended mechanism, over that provided by a regular extended telescopic boom, because in a regular telescopic boom the telescoping cylinder is connected directly between the two telescoping boom sections so only the boom is pivotally connected to the superstructure and to a member at the free end. In the present lower boom assembly the boom sections and telescopic cylinder are not connected directly to each other, and both the boom and the lower telescopic cylinder are connected to the superstructure at 10 and 16, respectively, in spaced relation, and both are also connected to the member 6 at their free ends at 13 and 18, respectively, in spaced relation. Thus, the mechanism provides two members 14 and 5, in laterally spaced relation to each other, one inside the other, connected between the turntable superstructure 1 at one end, and a member 6 at the opposite ends that provides the support for the upper boom assembly 7.

To fully elevate the platform, the upper lift valve and upper tele valve, not shown, for extending upper lift cylinder 29 and upper tele cylinder 28, respectively, can then be operated to raise and extend the upper telescopic boom assembly 7 and platform 8 to its maximum raised position, as shown in phantom lines in the uppermost position shown in FIG. 1. Upper boom assembly 7 can be luffed to any desired position or elevation in the vertical plane by upper lift cylinder 29, and the entire mechanism can be rotated as a unit by rotative turntable 3 about its vertical rotation axis relative to vehicle chassis 4. In conventional manner, the raising and lowering and positioning functions, as well as driving the vehicle chassis, are controlled from the work platform.

It is thus apparent that the hydraulic circuit of the machine must be operated in a certain sequence to insure proper stability of the machine, and contains interlocks to insure operation of the circuit and machine only in the proper sequence.

In lowering the platform from the raised position shown in FIG. 3 to the horizontal stowed position of FIG. 1, retracted position valve 34 is in the neutral position shown, and fluid is locked in extended lower tele lockout cylinder 22 and extended lower lift cylinder 19 by the holding valves therein, so these cannot be inadvertently retracted until fly section 11 is retracted into base section 9 of the lower boom assembly 5. Elevated position valve 43 is still in the position to the left in FIG. 8, and valve 46 is in the downward position supplying pressurized fluid from the pump P through valve 43 to pressure port 44. Lower tele cylinder control valve 45 is operated to the right as shown in FIG. 8, supplying fluid via hydraulic line 48 to the rod end of lower tele cylinder 14 thus retracting the same and retracting fly section 11 into base section 9. Fluid from the cylinder end of cylinder 14 returns to reservoir 39 via hydraulic line 47, through return port 49 and return lines 50 and 42. When fly section 11 is fully retracted into base section 9 by lower tele cylinder 14, and bottoms out therein so stop member **11*d* abuts against stop plate 9*d*, retracted position valve 34 is automatically actuated to the left in FIG. 8**.

Valve 46 is returned to the neutral position shown supplying fluid to valve 37. Valve 37 is actuated, downwardly in FIG. 8, supplying pressurized fluid therethrough, and through retracted position valve 34 to pressure port 35 of lower lift valve 36. Lower lift valve 36 is operable to the right, as shown in FIG. 8, and this releases lower tele lockout cylinder 22 and lower lift cylinder 19 from being rigid structural members, by supplying pressurized fluid via hydraulic line 59 to the rod ends of lower lift cylinder 19 and lower tele lockout cylinder 22, thus retracting the same and lowering the retracted lower boom assembly 5 to its lowered stowed position shown in FIG. 1, or any desired operating position inbetween, while always maintaining riser frame 6 in its vertical orientation. Fluid from the cylinder ends of cylinder 19 and 22 returns via hydraulic lines 38, return port 41, and return line 42 to reservoir 39.

In the lowering procedure the retraction and/or extension of the upper boom assembly 7 with telescopic fluid motor or cylinder 28, and luffing of the upper boom assembly with lift cylinder 29, is independent of the manipulation of lower boom assembly 5, and it can be extended and retracted and luffed while the lower boom is being retracted and lowered. The weight and load of the upper boom assembly 7 and work platform 8 is always counter-balanced by the counterweight 2 and the position of the outer end of lower boom assembly 5 and thus riser frame assembly 6 relative to the vertical rotation axis of turntable 3, since the latter is either on the axis or to the counterweight side of the axis at all times.

With the lower boom assembly 5 in its lowered and stowed positions show in FIG. 1, the upper boom assembly 7 is fully retracted and lowered to a slight negative angle down on top of the lower boom assembly 5 by lift cylinder 29, as shown in FIG. 1. In this position, the vehicle can be driven from place to place by controls in work platform 8, in the usual manner.

From the above description it will be appreciated by those skilled in the art that by the construction and arrangement of the lower telescopic boom section 5, riser frame assembly 6 and upper telescopic boom assembly 7 having the work platform 8 mounted on the end thereof, the reach of the aerial work platform is increased beyond the reach heretofore attained by conventional vehicular propelled aerial work platforms by means of a very stable mechanism.

It is to be understood that other hydraulic components and electrical components can be used in the schematic diagram of FIG. 8, other than those shown. For example, the retracted position valve 34 and elevated position valve 43 can be micro-switches connected in the control circuits of the associated valves, but actuated in the same manner as the hydraulic valves shown. Also, for example, a pressure/flow compensation pump system can be utilized.

The terms and expression which have been employed herein are used as terms of description and not of limitation, and there is no intention, in the use of such terms and expressions, of excluding any equivalents of the features shown and described or portions thereof, but it is recognized that various modifications are possible within the scope of the invention claimed.

We claim:

1. A vehicular aerial work platform comprising, a vehicle chassis, turntable means mounted on said vehicle chassis for rotation, support frame means mounted on said turntable means, a riser frame assembly, a telescopic boom having inner and outer ends, a telescopic cylinder assembly extending interior of said telescopic boom and having inner and outer ends, said inner and outer ends of said telescopic boom and said telescopic cylinder, respectively, pivotally connected to said support frame means and said riser frame assembly forming a telescopic parallelogram mechanism, work platform means connected to said riser frame assembly, and a lift cylinder connected between said turntable means and said telescopic boom for raising and lowering the telescopic boom in a vertical plane.

2. A vehicular aerial work platform according to claim 1, in which said inner and outer ends of said telescopic boom and said telescopic cylinder are respectively connected to said support frame means and said riser frame assembly in laterally offset positions.

3. A vehicular aerial work platform according to claim 1, in which said telescopic boom includes at least a base section having an inner end and a fly section slidably mounted in said base section and having an outer end, the inner end of said base section pivotally connected to said support frame means at a position above the pivotal connection of the inner end of said telescopic cylinder to said support frame, and the outer end of said fly section pivotally connected to said riser frame assembly at a position above the pivotal connection of the outer end of said telescopic cylinder to said riser frame assembly.

4. A vehicular aerial work platform according to claim 3, including a telescopic lockout cylinder operatively connected between said fly section and said riser frame assembly, and hydraulic control means operatively connected with said lift cylinder, telescopic lockout cylinder, and telescopic cylinder to operate said telescopic cylinder as a rigid link while said telescopic boom is moved from a lowered to a raised position by said lift cylinder, and to operate said telescopic lockout cylinder as a rigid link in the raised position of the telescopic boom and allow said telescopic cylinder to slidably move said fly section from said base section.

5. A vehicular self-propelled aerial work platform comprising a vehicle chassis, a turntable mounted on said vehicle chassis, a superstructure support frame mounted on said turntable, a lower telescopic boom assembly comprising a telescoping parallelogram mechanism, means pivotally connecting the end of said lower telescopic boom assembly to said support frame, a riser frame assembly, means pivotally connecting the riser frame assembly to the other end of the lower telescopic boom assembly, an upper telescopic boom assembly, means pivotally connecting one end of the upper telescopic boom assembly to said riser frame assembly, and a work platform connected to the opposite end of the upper telescopic boom assembly whereby the lower telescopic boom assembly can be elevated and extended to thereby extend the riser frame assembly and associated upper telescopic boom assembly, to thereby increase the reach of the aerial work platform.

6. A vehicular aerial work platform according to claim 5, wherein said lower telescopic boom assembly includes a lower telescopic cylinder assembly having opposite ends connected between said support frame and said riser frame assembly, for extending and retracting said lower telescopic boom assembly.

7. A vehicular aerial work platform according to claim 5, wherein said opposite end connections of said lower telescopic boom assembly and said opposite end connections of said lower telescopic cylinder assembly are laterally offset forming an extendable and retractable parallelogram mechanism.

8. A vehicular aerial work platform according to claim 5, in which said lower telescopic boom assembly comprises a lower telescopic boom including at least a base section and a fly section slidably mounted in said base section, a lower telescopic cylinder assembly extending interior of said fly section and said base section, said base section pivotally connected to said superstructure support frame, said fly section pivotally connected to said riser frame assembly, said lower telescopic cylinder assembly having opposite ends connected between said superstructure support frame and said riser frame assembly, whereby said lower telescopic boom and lower telescopic cylinder assembly form a telescoping parallelogram mechanism.

9. A vehicular self propelled aerial work platform according to claim 5, wherein the lower telescopic boom assembly comprises a base section pivotally connected at one end to said superstructure support frame, a fly section slidably mounted in the base section, the outer end portion of said fly section being pivotally connected to the riser frame assembly, a lower telescopic cylinder assembly having opposite ends and mounted within said fly section, one end of said lower telescopic cylinder assembly being pivotally connected to said superstructure support frame, the opposite end of said lower telescopic cylinder assembly being pivotally connected to said riser frame assembly, and a lower lift cylinder having opposite ends, one end of said lower lift cylinder pivotally connected to the superstructure support frame assembly, and its opposite end pivotally connected to said base section.

10. A vehicular self propelled aerial work platform according to claim 9, including a lower telescopic lockout cylinder operatively connected between the fly section and riser frame assembly, and hydraulic control means connected with said lower lift cylinder, lower telescopic lockout cylinder and lower telescopic cylinder assembly to operate said lower telescopic cylinder assembly as a rigid link while the lower telescopic boom assembly is moved from a lowered to an elevated position by said lower lift cylinder, and to operate said lower telescopic lockout cylinder as a rigid link in the elevated position of the lower telescopic boom assembly and allow said lower telescopic cylinder assembly to move said fly section to an extended position.

11. A vehicular self propelled aerial work platform according to claim 10, and said hydraulic control means connected to operate said lower lift cylinder as a rigid link simultaneously with said lower telescopic lockout cylinder being operated as a rigid link.

12. A vehicular self-propelled aerial work platform according to claim 10, wherein the upper telescopic boom assembly comprises a base section pivotally connected to the riser frame assembly, a fly section slidably mounted on the base section, a work platform mounted on the outer end of the fly section, and an upper lift cylinder connected between said riser frame assembly and the base section of the upper boom assembly, whereby the upper boom assembly can be elevated to various working positions.

13. A vehicular self-propelled aerial work platform according to claim 9, wherein the superstructure support frame comprises, a pair of parallel, spaced plates extending upwardly from said turntable, a pair of brackets fixed to the side walls of the base section and positioned in the space between said plates, the pivot connection for the base section extending through said plates and brackets, another plate assembly mounted on the turntable in the space between said pair of plates, the pivot connection for said one end of the lower telescopic cylinder assembly extending through said another plate assembly.

14. A vehicular self propelled aerial work platform according to claim 13, and the pivot connection for said one end of said lower lift cylinder connected to said another plate assembly.

15. A vehicular self-propelled aerial work platform according to claim 9, wherein the riser frame assembly comprises a housing having side walls, a top wall and an end wall, the lower end portions of the side walls tapering inwardly to an abutting relationship, the pivot connection for said opposite end of said lower telescopic cylinder extending through said abutting portions of said side walls, a pair of spaced plates secured to the side walls of said fly section and extending upwardly therefrom to straddle the riser frame side walls, the pivotal connection for the riser frame and fly section extending through the riser frame side walls and said pair of upwardly extending spaced plates.

16. A vehicular self-propelled aerial work platform according to claim 10, including a bracket fixed to the top wall of the fly section and extends upwardly therefrom, said lockout cylinder having opposite ends, a pivotal connection between one end of said lockout cylinder and said bracket, and a pivotal connection between said riser frame assembly and the opposite end of said lockout cylinder.

17. A vehicular self propelled aerial work platform according to claim 16, in which said base section has a top wall, a longitudinally extending slot in the top wall of said base section adjacent the outer end of the base section, whereby said bracket moves into and out of said slot as said fly section is respectively retracted into and extended from said base section.

18. A telescoping boom structure comprising, support frame means, a riser frame assembly, a boom base section having an inner end pivotally connected to said support means, at least a boom fly section telescopically mounted in said boom base section and having an outer end pivotally connected to said riser frame assembly, an extendable and retractable power means extending interior of said boom fly section and boom base section and having inner and outer ends, said inner end of said power means pivotally connected to said support means, and said outer end of said power means pivotally connected to said riser frame assembly forming a telescoping parallelogram mechanism with said telescopically mounted boom fly section and base section, means to be lifted connected to said riser frame assembly, and a lift cylinder pivotally connected between said support means and said boom base section for raising and lowering the telescoping parallelogram mechanism in a vertical plane, whereby upon extension and retracting of said power means said parallelogram mechanism is extended and retracted.

19. A telescoping boom structure as set forth in claim 18, wherein said support means includes a pair of substantially vertical, spaced, parallel plates, said inner end of said boom base section pivotally connected between said pair of plates, said support means including a further support plate connected between said pair of plates, and said inner end of said power means pivotally connected to said further support plate.

20. A telescoping boom structure as set forth in claim 19, in which said inner end of said base section includes a bottom wall, and slit in said bottom wall of said base section extending longitudinally adjacent the inner end, and said further support plate adapted to enter said slit when said base section is moved to a lowered position by said lift cylinder.

21. A telescoping boom structure as set forth in claim 20, in which said fly section has an inner end positioned adjacent the inner end of said base section in the retracted position, said fly section including a bottom wall, second slit means in the bottom wall of said fly section extending longitudinally adjacent the inner end thereof, and said further support plate adapted to enter said second slit means when said fly section is retracted in said base section and said base section is moved to a lowered position.

22. A telescoping boom structure as set forth in claim 18, in which said fly section has a top wall, an opening in the top wall of said fly section extending inwardly from the outer end thereof, and said riser frame assembly having a portion adjacent the pivotal connection between said power means and said riser frame assembly adapted to pivotally relate into said opening in the top wall of said fly section as said base section and fly section are moved to a raised position by said lift cylinder.

23. A telescoping boom structure as set forth in claim 22, in which said base section has a top wall, a longitudinally extending slot in the top wall of said base section extending inwardly from the outer end thereof and in alignment with said opening in the top wall of said fly section, whereby said portion of said riser frame assembly is adapted to pivotally rotate into said slot when said retracted base section and fly section are moved to a raised position.

24. A telescoping boom structure as set forth in claim 18, including a telescopic lockout cylinder pivotally connected between the fly section and riser frame assembly, and hydraulic control means connected with said lift cylinder, telescopic lockout cylinder, and power means to operate said power means as a rigid link while the retracted fly section and base section are moved by said lift cylinder from a lowered to a raised position, and to operate said telescopic lockout cylinder as a rigid link in the elevated position of the base section and fly section and allow said power means to move said fly section to an extended position from said base section.

25. A telescoping boom structure as set forth in claim 24, and said hydraulic control means connected to operate said lift cylinder as a rigid link simultaneous with said telescopic lockout cylinder being operated as a rigid link.

26. A telescoping boom structure as set forth in claim 24, in which said fly section has a top wall, a bracket fixed to the top wall of said fly section and extending upwardly therefrom, and said lockout cylinder having opposite ends pivotally connected between said bracket and said riser frame assembly.

27. A telescoping boom structure as set forth in claim 26, in which said base section has a top wall, slot means in said top wall extending longitudinally inwardly from the outer end of the base section, and said bracket moveable out of and into said slot as said fly section is respectively extended from and retracted into said base section.

28. A telescoping boom structure as set forth in claim 24, in which said hydraulic control means includes a hydraulic circuit, first interlock means connected in said hydraulic circuit for actuation to a first state to lock the hydraulic circuit to said power means to operate said power means as a rigid link while the retracted fly section and base section are moved between a lowered position and a raised position, and connected for actuation to a second state when said fly section and base section are in a fully raised position to unlock the hydraulic circuit to said power means allowing said fly section to be extended from and retracted into said base section.

29. A telescoping boom structure as set forth in claim 28, in which said hydraulic circuit includes second interlock means connected therein for actuation to a first state when said fly section is fully retracted into said base section to allow the hydraulic circuit to extend and retract said lift cylinder and telescopic lockout cylinder, and connected for actuation to a second state when said fly section is extended from said base section by said power means to lock the hydraulic circuit to said lift cylinder and telescopic lockout cylinder and operate said lift cylinder and telescopic lockout cylinder as rigid links.

30. A telescoping boom structure as set forth in claim 18, including cooperating stop means on said boom fly section and said boom base section in contact in the retracted position of said telescoping parallelogram mechanism.

* * * * *